US006320478B1

(12) United States Patent
Sims, III

(10) Patent No.: US 6,320,478 B1
(45) **Date of Patent: *Nov. 20, 2001**

(54) POWER DIVIDER FOR HARMONICALLY RICH WAVEFORMS

(75) Inventor: William Herbert Sims, III, Decatur, AL (US)

(73) Assignee: The United States of America as represented by the Administrator of the National Aeronautics and Space Administration, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/182,553

(22) Filed: Oct. 29, 1998

(51) Int. Cl.[7] ..... H01P 5/12; H01P 3/08

(52) U.S. Cl. ..... 333/127; 333/136

(58) Field of Search ..... 333/125, 127, 333/128, 136, 26

(56) References Cited

U.S. PATENT DOCUMENTS

| | | | | |
|---|---|---|---|---|
| 4,356,462 | * | 10/1982 | Bowman | 333/128 |
| 4,460,877 | * | 7/1984 | Sterns | 333/26 |
| 4,636,757 | * | 1/1987 | Harrison et al. | 333/218 |
| 5,363,072 | * | 11/1994 | Sakamoto et al. | 333/125 |

* cited by examiner

*Primary Examiner*—Robert Pascal
*Assistant Examiner*—Kimberly E Glenn
(74) *Attorney, Agent, or Firm*—James J. McGroary

(57) ABSTRACT

A power divider divides an RF signal into two output signals having a phase difference of 180° or a multiple thereof. When the RF signal is a square wave or another harmonically rich signal, the phases of the fundamental and the harmonics have the proper relationship. The divider can be implemented in the form of microstrips on a board, with one of the output microstrips having several bends to provide a different electrical length from the other.

20 Claims, 8 Drawing Sheets

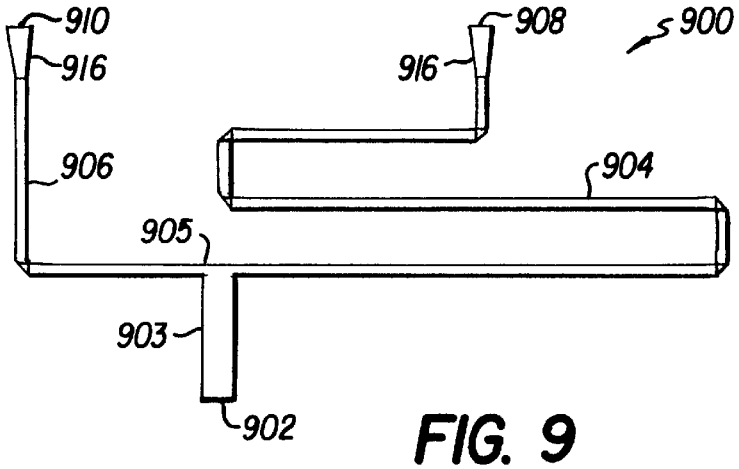
FIG. 9
FIG. 10
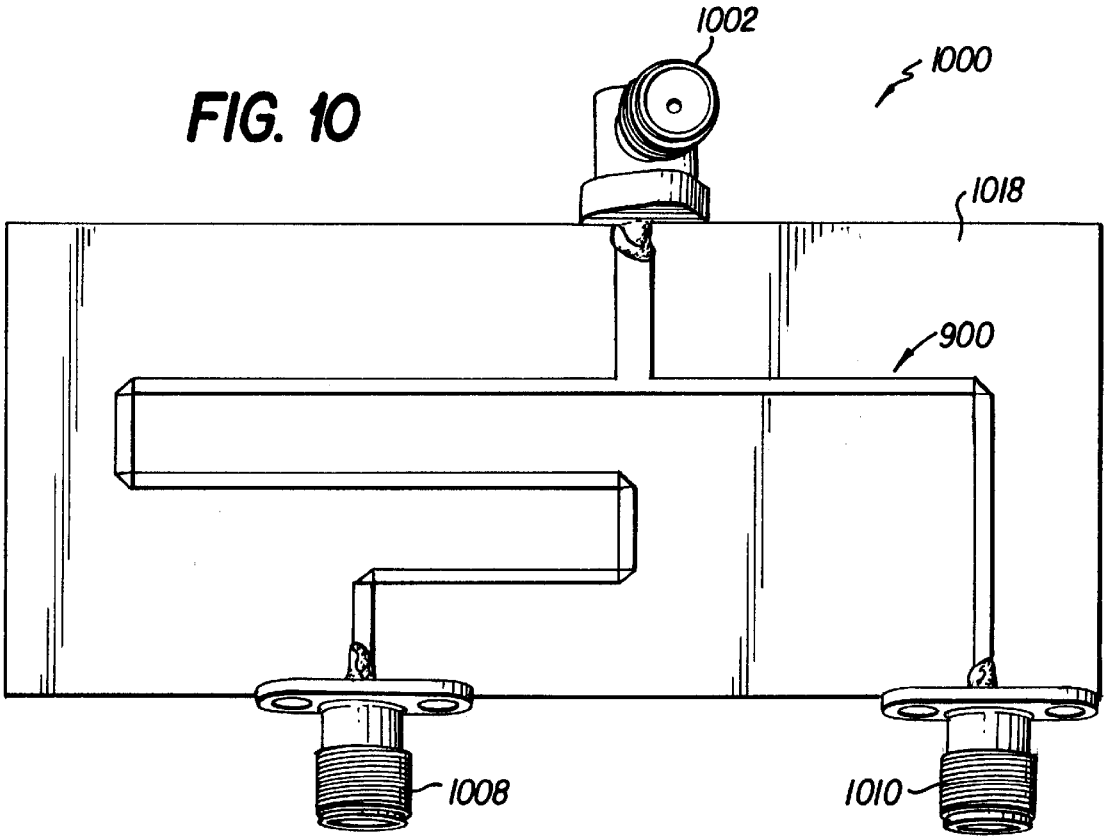

POWER DIVIDER FOR HARMONICALLY RICH WAVEFORMS

CROSS-REFERENCE TO RELATED APPLICATION

This application claims the benefit of U.S. Provisional Application No. 60/065,036, filed Nov. 10, 1997, and titled "Power Divider for Harmonically Rich Waveforms," whose disclosure is hereby incorporated by reference in its entirety into the present disclosure.

ORIGIN OF INVENTION

This invention was made by an employee of the United States Government and may be manufactured and used by or for the Government for Governmental purposes without the payment of royalties.

BACKGROUND OF INVENTION

1. Field of the Invention

The present invention is directed to a power divider for waveforms having strong higher harmonics, such as square waves, and particularly to such a power divider that imparts a phase difference of 180° between branches for radio communication.

2. Description of Related Art

Many RF (radio-frequency) and microwave communication systems, especially those using mobile telephones such as cellular and PCS (personal communication system) telephones, rely on the transmission of square waves. The square wave is rich in harmonic content, specifically odd-order harmonics. More specifically, a square wave of fundamental frequency f has harmonics of order 3f, 5f, 7f, . . . , or in other words $\xi$f, where $\xi$ is an odd integer. The amplitude of each harmonic of order $\xi$, normalized to the amplitude of the fundamental, goes as $1/\xi$, as shown in FIG. 1.

Accurate amplification and delivery of a square wave to the individual stages require division of this RF waveform. For generation of large output power levels, the driving waveform is divided into a minimum of two waveforms. Each waveform is fed into an amplifier stage, amplified, and then recombined with the other waveforms.

There are currently several techniques for dividing the waveform. Current techniques to divide a waveform for use by multiple amplifiers include the Wilkinson hybrid, radial wave power hybrid, multiport power divider using circular-sector-shaped planar components, and many other types of microwave hybrids. However, because of design constraints, namely, the extremely wide bandwidth needed for a waveform with significant higher-order harmonics, the current power dividers are incapable of dividing a harmonically rich waveform.

Each of the current dividers has drawbacks that make it unusable in a harmonically rich environment such as that of the High Efficiency Microwave Power Amplifier (HEMPA). Each topology will be shown to exhibit characteristics that make it unsuitable.

The Wilkinson hybrid is a popular method for increasing the power output of amplifier sections. This method of dividing is inherently easy to design and implement. There are some drawbacks, however. First, the number of devices combined in this type of topology is restricted to powers of two (i.e., $2^N$ where N is a positive integer). Second, the combining efficiency decreases rapidly as the number of outputs increases because of the strong dependence on the losses within the divider. Also, the size of the divider increases drastically as the number of outputs increases.

For waveforms free of harmonics, the Wilkinson hybrid coupler is an attractive choice for RF engineers. However, since square waves are harmonically rich, the Wilkinson hybrid coupler is unusable with such waves because of certain restrictions imposed by its design.

The first restriction deals with the limited bandwidth of the hybrid coupler. The usable bandwidth of most Wilkinson hybrids is 1 to 1.5 octaves. The waveform that is inherent in the HEMPA is more than four octaves in bandwidth. This in itself makes the Wilkinson hybrid unusable.

The second problem associated with the Wilkinson hybrid deals with the main problem of the Wilkinson topology and the nonplanarity of the circuit due to the presence of the floating node connecting the isolation resistor to the outputs.

With these two major problems associated with the Wilkinson hybrid, the use of this topology in the HEMPA is precluded.

The Radial wave power hybrid incorporates a radially periodic internal structure. This structure uses techniques similar to those used for distributed element filter design. This method offers a superior approach to high-order, high-power combining. The general guideline for this type of divider deals with an impedance matching problem whereby an equivalent source impedance of $Z_0/N$ must be matched to the common port impedance. This is usually done using a lumped element filter network, thus imparting a frequency dependence to the network. Therefore, this type of topology is also unusable for applications using square waves.

The final type of power divider uses circular shaped planar components. The circular-sector topology has one major drawback in that the usable bandwidth is very narrow (i.e., approximately 10% of the center frequency). This major constraint makes the circular sector topology useless.

This difficulty in dividing and combining square waves has limited the efficiency of power generation in cellular telephones. The present state of the art in amplification at microwave frequencies has been precluded from incorporating high-efficiency techniques because of the above-noted constraints inherent to the design.

Another problem with known dividers is that they have lengths in increments of $\lambda/4$, where $\lambda$ is the wavelength of the waveform. In this case, the fundamental component, having a wavelength of $\lambda$, travels one-quarter of its own wavelength. However, the third-order ($\xi$=3) harmonic, having a wavelength of $\lambda/3$, travels over three-quarters of its own wavelength. The fundamental and third-order components are thus made to be 180° out of phase. The fifth-order ($\xi$=5) harmnonic, having a wavelength of $\lambda/5$, travels over five-quarters of its own wavelength, or a complete cycle plus one-quarter of its own wavelength, and thus is maintained in phase with the fundamental. Accordingly, the harmonics are alternately in phase and 180° out of phase with the fundamental. As a consequence, the waveform is distorted beyond usability.

Cellular-telephone manufacturers spend millions of dollars per year on research and development to improve cellular-telephone technology. One area of research deals with increasing the battery life and operating time, which are currently limited by the efficiency of power amplification.

SUMMARY OF THE INVENTION

An object of the invention is to provide a power divider which overcomes the above-noted problems of the prior art, particularly the problem of bandwidth.

Another object of the invention is to provide a power divider for square waves and other harmonically rich waveforms.

To achieve these and other objects, the present invention is directed to a power divider for dividing an input signal into a first output signal and a second output signal, the power divider comprising: an input transmission line for transmitting the input signal to a T-point at which the input signal is split into a first portion and a second portion; a first output transmission line, receiving the first portion at the T-point, for transmitting the first portion while imparting a first phase delay to the first portion to form the first output signal; and a second output transmission line, receiving the second portion at the T-point, for transmitting the second portion while imparting a second phase delay to the second portion to form the second output signal; wherein the first phase delay and the second phase delay have a difference which is a non-zero integer multiple of 180°.

The invention is further directed to a method of dividing an input signal into a first output signal and a second output signal, the method comprising: (a) splitting the input signal into a first portion and a second portion; (b) imparting a first phase delay to the first portion to form the first output signal; and (c) imparting a second phase delay to the second portion to form the second output signal; wherein the first phase delay and the second phase delay have a difference which is a non-zero integer multiple of 180°.

BRIEF DESCRIPTION OF THE DRAWINGS

A preferred embodiment of the invention will now be set forth in detail with reference to the drawings, in which:

FIG. 9 shows a microstrip layout constructed in accordance with the modification of FIG. 7;

FIG. 10 shows a divider incorporating the microstrip layout of FIG. 9;

DETAILED DESCRIPTION OF THE PREFERRED EMBODIMENT

Figure 1:
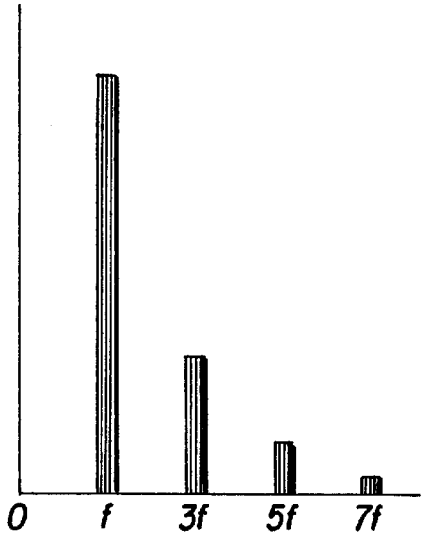
FIG. 1 (PRIOR ART)
FIG. 1 shows the relationship between normalized amplitude and frequency for the harmonics of a square wave.

A power divider for square waves must satisfy three requirements. First, as noted above, the fundamental component and the higher-order harmonics must maintain their phase and amplitude relationship. As noted above and shown in FIG. 1, the normalized amplitude of each harmonic of order $\xi$ goes as $1/\xi$.

Figure 2:
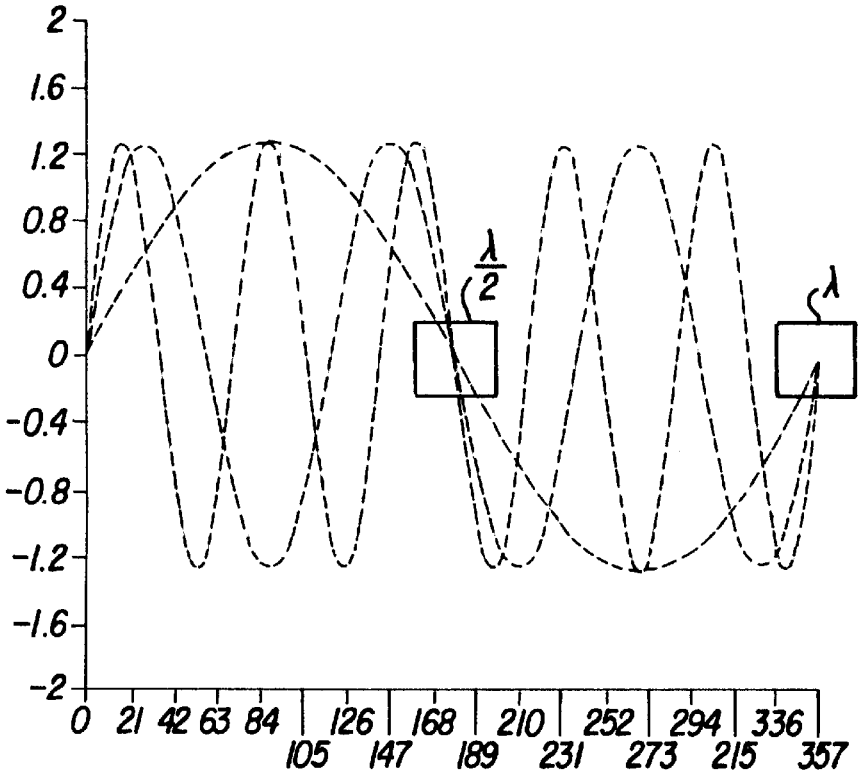
FIG. 2 shows a relationship between normalized phase and frequency for the harmonics of a square wave.

Second, the harmonics, normalized to the fundamental, must be equal in phase at the output to preserve the waveform. FIG. 2 shows the normalized phases for various harmonic components: as can be seen in the boxed portions of this figure, the phases are equal only at multiples of $\lambda/2$ where $\lambda$ is the wavelength of the waveform. Known divider topologies use $\lambda/4$ lengths and therefore cannot meet this requirement. Therefore in the instant invention the ratio of lengths between the two output transmission lines provides that the harmonic frequencies output from each of the transmission lines are in phase with each other.

Figure 3:
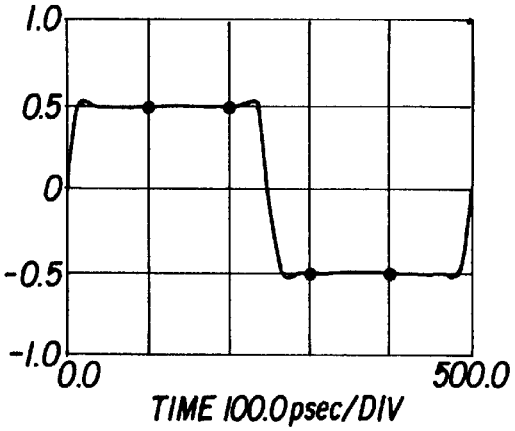
FIG. 3 shows an input signal.
Figure 4:
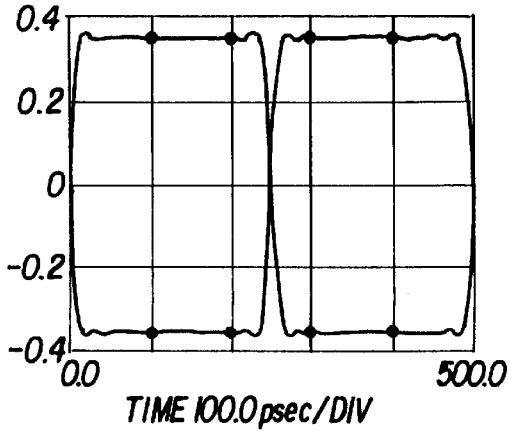
FIG. 4 shows the two output signals to be produced from the input signal.

The third requirement is that the signals output from the divider be equal in amplitude and opposite in phase. For example, if the waveform shown in FIG. 3 is input, the waveforms shown in FIG. 4 should be output. This requirement allows push-pull configurations such as that used in HEMPA.

Before the divider was designed, simulations were done to verify the above concepts. The first simulations were done in the transmission line simulation software jOmega, which is published by HP/EESof. The simulation was conducted on two perfect transmission lines of lengths $\lambda$ and $\lambda/2$, respectively, and a fundamental frequency of 2 Ghz.

Figure 5:
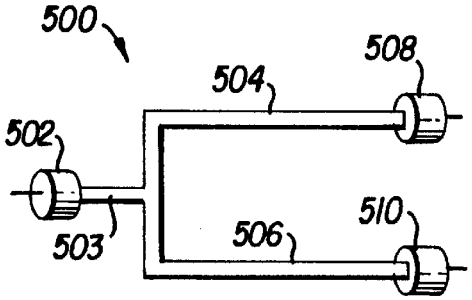
FIG. 5 shows a setup used in a computer simulation of the invention.

More specifically, in simulated divider 500 shown in FIG. 5, a waveform input through input port 502 to input coaxial transmission line 503 is split between output coaxial transmission lines 504 and 506, and the divided signals are output at output ports 508 and 510. Divider 500 has an input impedance at input port 502 of 100Ω and an output impedance at each of output ports 508 and 510 of 50Ω. Each of coaxial transmission lines 503, 504, and 506 is defined by three characteristics: characteristic impedance $Z_0$, electrical length E in degrees, where 360°=the wavelength of the waveform, and design frequency F for which E is calculated. For all of the transmission lines, F=2 GHz. The transmission lines have the following values of $Z_0$ and E:

| Transmission line | $Z_0$ | E |
|---|---|---|
| Input transmission line 503 | 50 Ω | 90° |
| Output transmission line 504 | 70.70 Ω | 90° |
| Output transmission line 506 | 70.70 Ω | 270° |

Figure 6:
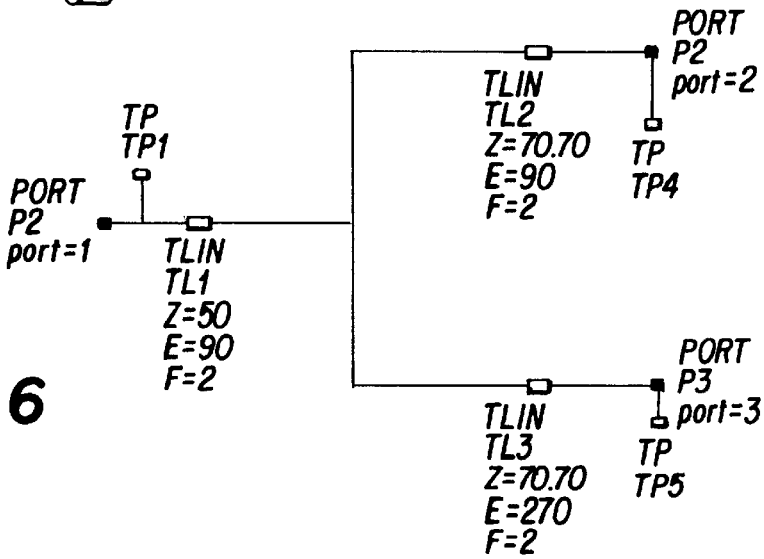
FIG. 6 shows the setup of FIG. 5 as entered into simulation software.

The value 70.70Ω is selected because it is the geometrical mean of the impedances at the input and output ports. The electrical lengths of transmission lines 504 and 506 differ by 180°. This information was input to jOmega in the form shown in FIG. 6.

Divider 500 was simulated with an input having a frequency of 2 GHz and the waveform of FIG. 3. The resulting outputs match the desired outputs shown in FIG. 4.

Also monitored during this simulation were the phase difference of each higher-order harmonic at the output ports from the fundamental at the input port and the voltage standing wave ratio (VSWR) for each port at each frequency of interest. The values are set forth below.

| Port | Harmonic ξ | VSWR | Coupling (dB) | \|Phase\| |
|---|---|---|---|---|
| 502 | 1 | 1.0003 | N/A | N/A |
| 502 | 3 | 1.0003 | N/A | N/A |
| 502 | 5 | 1.0003 | N/A | N/A |
| 502 | 7 | 1.0003 | N/A | N/A |
| 508 | 1 | 1.0003 | −3.0002 | 0.0003 |
| 508 | 3 | 1.0003 | −3.0002 | 0.0003 |
| 508 | 5 | 1.0003 | −3.0002 | 0.0003 |
| 508 | 7 | 1.0003 | −3.0002 | 0.0003 |
| 510 | 1 | 1.0003 | −3.0002 | 180.0 |
| 510 | 3 | 1.0003 | −3.0002 | 180.0 |
| 510 | 5 | 1.0003 | −3.0002 | 180.0 |
| 510 | 7 | 1.0003 | −3.0002 | 180.0 |

The phase differences closely match those desired. Thus, this simulation theoretically validates the basic concepts of the divider according to the present invention.

However, since the simulation described above was carried out under the assumption of perfect transmission lines, another simulation was carried out with striplines or microstrips. Again, jOmega was used for the simulation. The configuration of FIG. 6 was modified to result in the configuration of FIG. 7. In this configuration, a signal input to input port 702 travels through input line 703 and T-connector 712 to output lines 704 and 706 and thence to output ports 708 and 710. Each of lines 704 and 706 includes bend portions 714. The output lines have total electric lengths differing by 180°. Tapered portions 716 at both output ports are provided only to allow the easy connection of SMA connectors to the printed circuit board. These connectors allow the circuit board to be connected to a network analyzer for simulation verification, as will be described below. The circuit board is formed of Rogers RT/Duroid 5880, 15 mils thick, and 2-ounce copper. Rogers RT/Duroid 5880 has a dielectric constant $\in_r=2.2\pm0.02$ and is designed for use beyond 18 Ghz. The output waveforms are shown in FIG. 8 and described in the table below.

| Port | Harmonic ξ | VSWR | Coupling (dB) | Phase |
|---|---|---|---|---|
| 702 | 1 | 1.6128 | N/A | N/A |
| 702 | 3 | 1.5632 | N/A | N/A |
| 702 | 5 | 1.6730 | N/A | N/A |
| 702 | 7 | 1.5642 | N/A | N/A |
| 708 | 1 | 1.6015 | −3.5224 | 2.0773 |
| 708 | 3 | 1.4793 | −3.8779 | 4.6293 |
| 708 | 5 | 1.6821 | −3.8862 | 3.9123 |
| 708 | 7 | 1.6220 | −4.2626 | 0.7152 |
| 710 | 1 | 1.5923 | −3.3620 | 177.8 |
| 710 | 3 | 1.5886 | −3.3485 | 177.2 |
| 710 | 5 | 1.5919 | −3.7424 | 175.3 |
| 710 | 7 | 1.4633 | −3.5616 | 177.5 |

Figure 7:
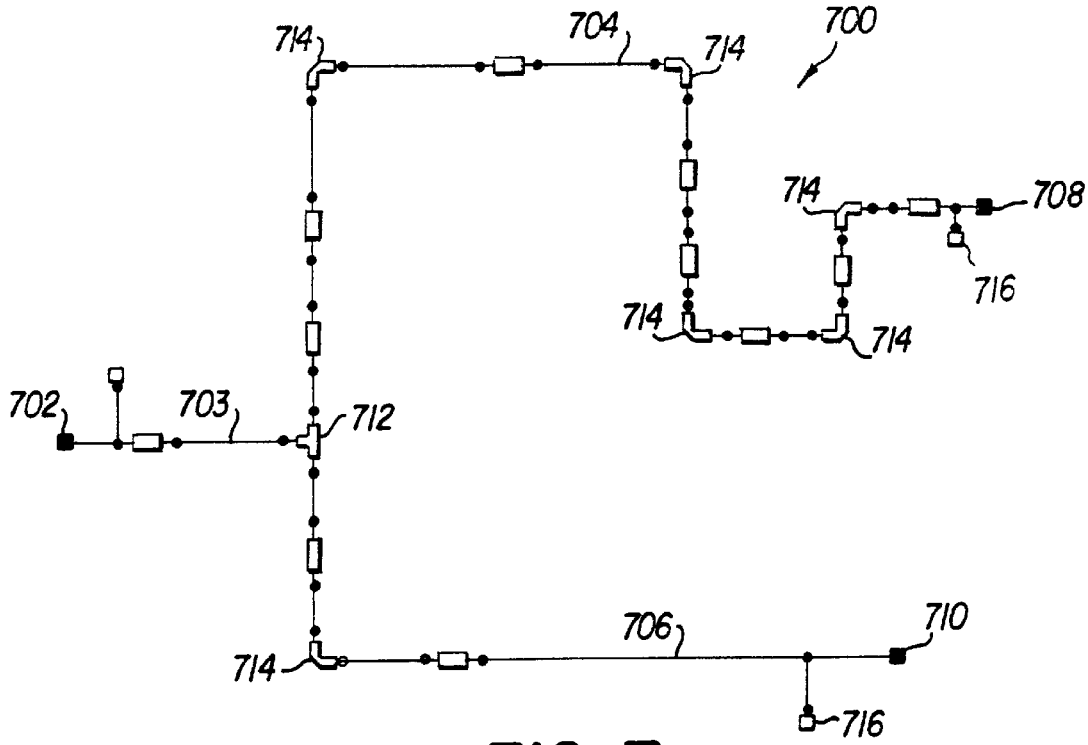
FIG. 7 shows a modification of FIG. 6 used for a second computer simulation of the invention.
Figure 8:
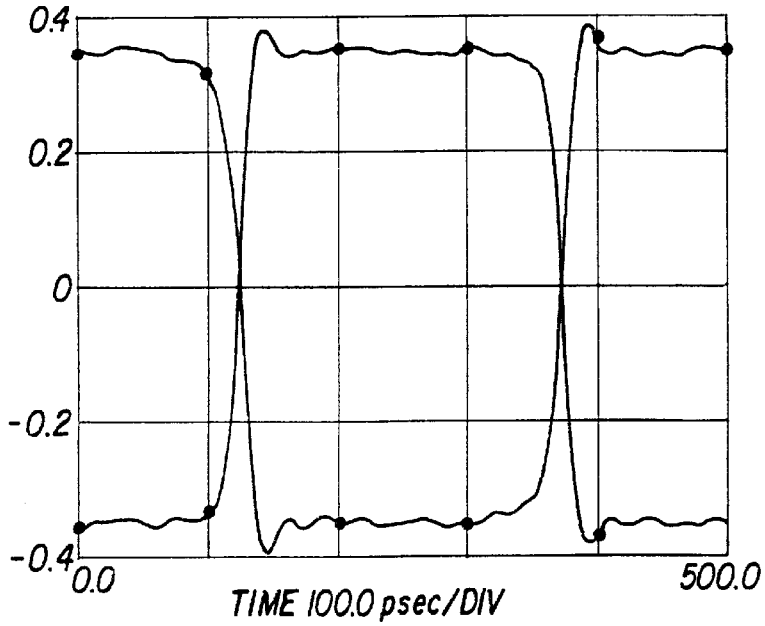
FIG. 8 shows a simulation result obtained from the modification of FIG. 7.

As can be seen from FIG. 8 and the table above, the modified simulation setup of FIG. 7 still produces excellent results.

After these simulations, a working model of the divider was built. The microstrip lines followed the layout of FIG. 7. The resulting layout shown in FIG. 9, had final size measurements of 2.0 inches in length and 1.0 inches in width. As shown in FIG. 9, layout 900 has input port 902 leading to input stripline 903. At T-point 905, stripline 903 branches into output striplines 904 and 906, each of which has tapered portion 916. The output striplines end in output ports 908 and 910. The trace widths and lengths are given in the table below.

| Port | Width | Length |
|---|---|---|
| 902 | 71 | 290 |
| 908 | 27 | 3045 |
| 910 | 27 | 1124 |

The length to each port is measured from T-point 905. The dimensions are in mils.

The divider assembled with layout 900 is shown in FIG. 10. Divider 1000 has microstrip layout 900 on board 1018. Coaxial connectors 1002, 1008, and 1010 are connected to ports 902, 908, and 910. Divider 1000 was assembled using a T-Tech milling machine and associated hardware, although any other suitable technique can be used.

As can be seen in FIG. 10, divider 1000 is very compact. Testing was done using a Hewlett/Packard network analyzer, model 8719C, capable of operations only to 13.5 GHz. To discount the phasing effects of the SMA connectors on the test board, a delay factor of 20.67 mm (or 68.936 pS) was added to the overall network analyzer calibration. The experimental results are set forth below.

| Port | Harmonic ξ | VSWR | Coupling (dB) | Phase |
|---|---|---|---|---|
| 902 | 1 (2 GHz) | 1.73 | N/A | N/A |
| 902 | 3 (6 GHz) | 1.17 | N/A | N/A |
| 902 | 5 (10 GHz) | 1.50 | N/A | N/A |
| 902 | 7 (14 GHz) | N/A | N/A | N/A |
| 908 | 1 | 2.37 | −2.74 | −174.3 |
| 908 | 3 | 2.04 | −3.39 | −168.6 |
| 908 | 5 | 1.61 | −3.10 | −174.5 |
| 908 | 7 | N/A | N/A | N/A |
| 910 | 1 | 2.60 | −3.31 | 12.2 |
| 910 | 3 | 1.95 | −3.52 | 18.6 |
| 910 | 5 | 1.63 | −3.21 | 0.0 |
| 910 | 7 | N/A | N/A | N/A |

One interesting note should be made concerning the VSWR for the output ports. During all the simulations of the divider, both ports were fed waveforms that were 180 degrees out of phase and of equal amplitudes. However, since the network analyzer is a two-port measurement device, one of the divider ports is not fed a signal source. Therefore, to equalize the measurements of simulation, another simulation was initiated. This simulation merely terminated one of the divider ports into 50 kΩ. The new VSWR calculations are shown in the table below, compared with the experimental results set forth above.

| Port | Harmonic ξ | Predicted VSWR | Actual VSWR | % difference |
|---|---|---|---|---|
| 702 or 902 | 1 | 1.6093 | 1.73 | 7.5 |
| 702 or 902 | 3 | 1.5762 | 1.17 | 25.8 |
| 702 or 902 | 5 | 1.6530 | 1.50 | 9.3 |
| 702 or 902 | 7 | 1.6067 | N/A | N/A |
| 708 or 908 | 1 | 2.4428 | 2.37 | 2.9 |
| 708 or 908 | 3 | 2.3442 | 2.04 | 12.9 |
| 708 or 908 | 5 | 2.2660 | 1.61 | 29.0 |
| 708 or 908 | 7 | 2.3106 | N/A | N/A |
| 710 or 910 | 1 | 2.4795 | 2.60 | 4.6 |
| 710 or 910 | 3 | 2.2677 | 1.95 | 14.0 |
| 710 or 910 | 5 | 2.5711 | 1.63 | 36.6 |
| 710 or 910 | 7 | 2.3002 | N/A | N/A |

As can be seen from the table set forth above, all of the actual measurements were better than predicted for the VSWR. With the actual circuit matching the simulation circuit, the concepts of the present invention have been experimentally validated.

A second area of concern deals with the signal source being modulated, thus increasing the signal from a constant continuous wave (CW) to a bandwidth limited signal. This bandwidth limited signal would impose frequency shifts to the center frequency. This frequency shifts would in turn cause the phase delay of each component of the square wave to change and thus destroy the phase relationship of the harmonic components. For instance, if the fundamental frequency phase delay were shifted by 5°, the seventh harmonic would be shifted 35°. How much this would affect the waveform will be shown. Simulations were run to evaluate and determine a usable bandwidth for this type of coupler.

Figure 11:
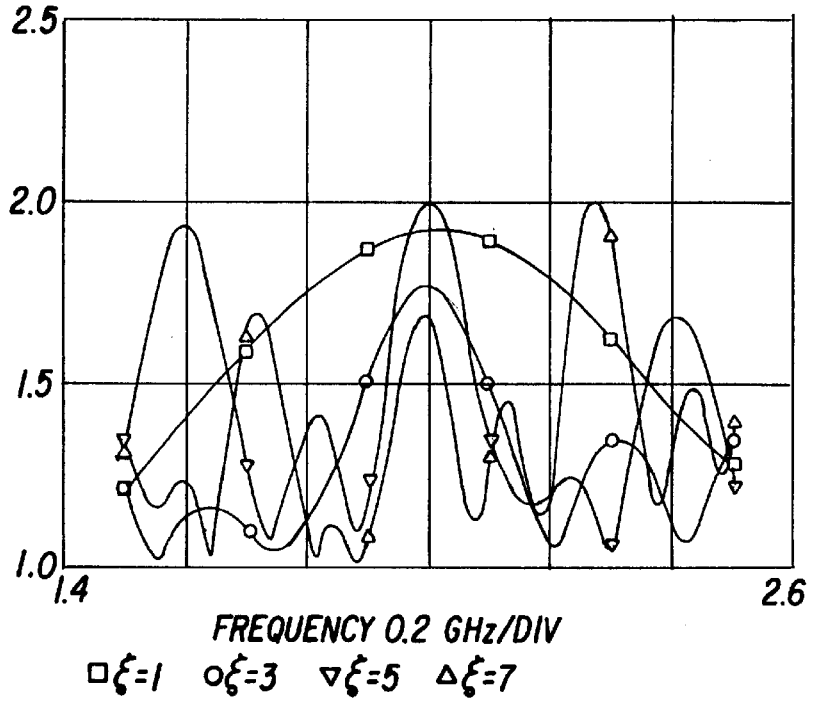
FIGS. 11–13 show simulations of VSWR across a 50% bandwidth relative to a 2 GHz center frequency.
Figure 12:
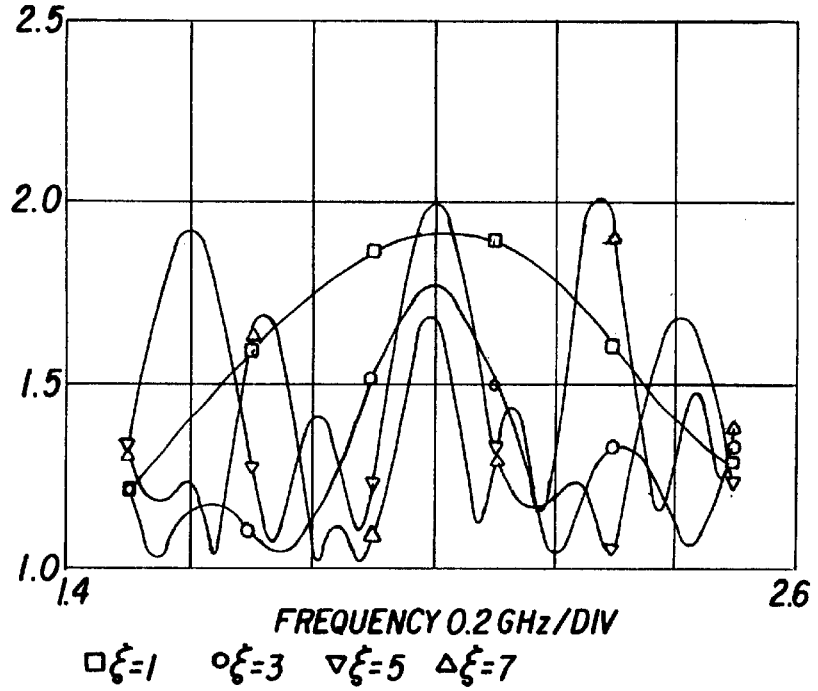
Figure 13:
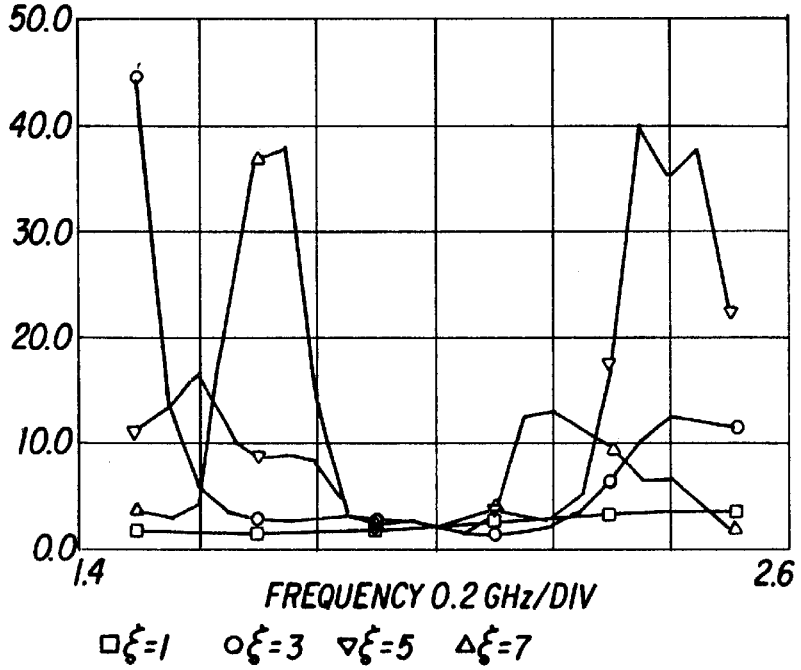

This first type of simulation evaluated the VSWR across a 50% percent bandwidth relative to the 2 GHz center frequency. These results are shown in FIGS. 11–13. FIG. 10 shows the VSWR for the input port (port 702 in the simulation or 902 in the constructed device) of the divider. As can be seen in this figure, the input VSWR is below 2:1 across this entire frequency range. FIGS. 12 and 13 show the VSWR for ports 708 (or 908) and 710 (or 910) respectively.

Figure 14:
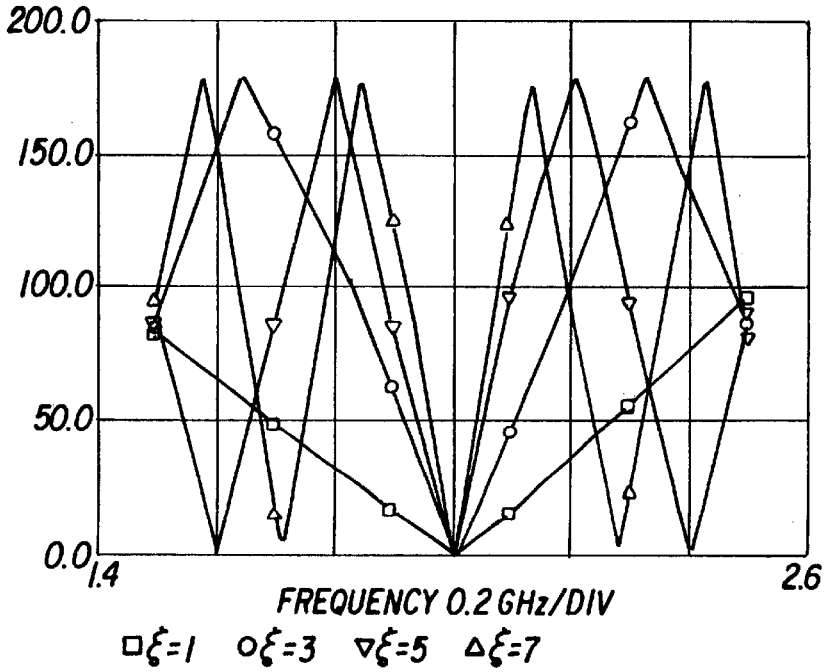
FIGS. 14 and 15 show input-to-output phase simulations for the same bandwidth.
Figure 15:
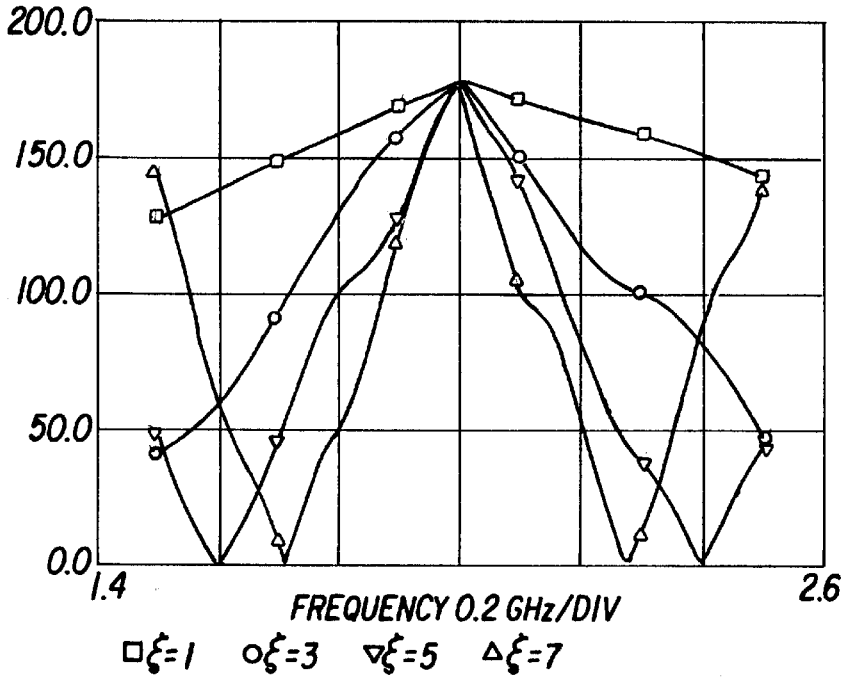
Figure 16:
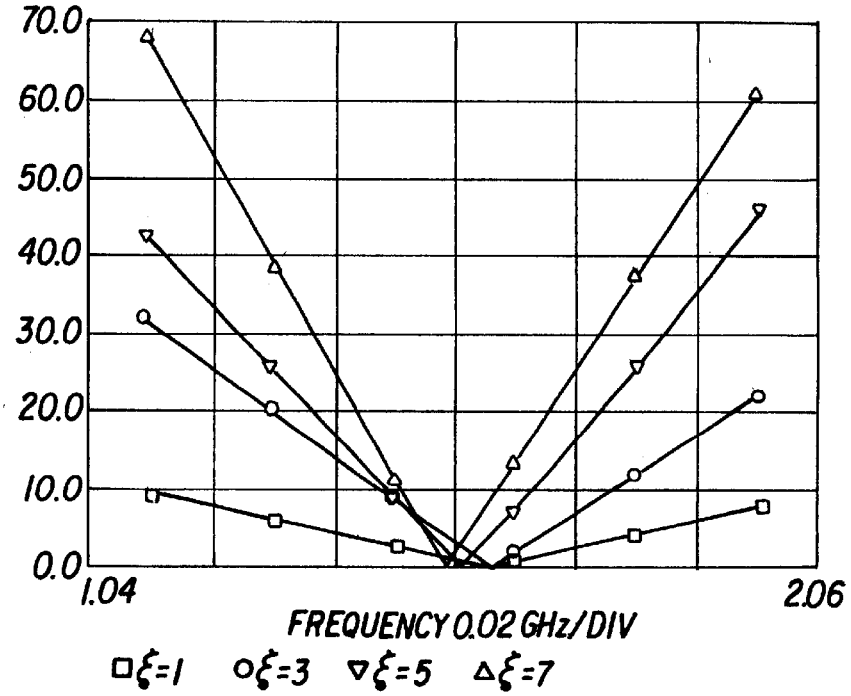
FIGS. 16 and 17 show input-to-output phase simulations for a 5% bandwidth relative to the 2 GHz center frequency.
Figure 17:
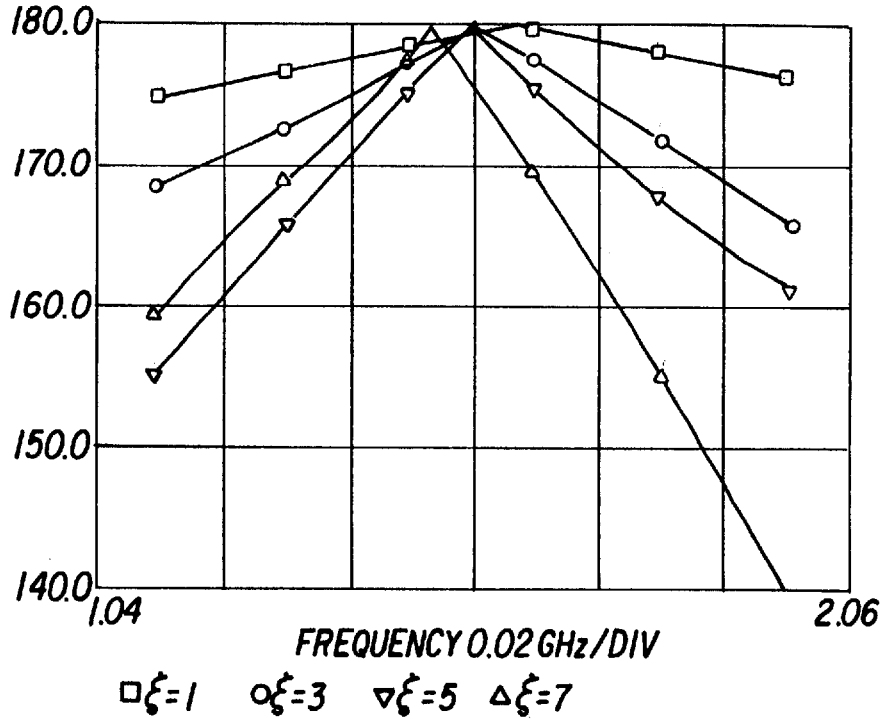

Another simulation was run to determine phase characteristics in the same bandwidth. The results are shown for the input-to-output phase between ports 702 and 708 in FIG. 14 and between ports 702 and 710 in FIG. 15. The simulation was run again with a 5% bandwidth, and the results are shown between ports 702 and 708 in FIG. 16 and between ports 702 and 710 in FIG. 17.

With the 5% bandwidth, the third harmonic has approximately 8° of difference relative to the fundamental. The next item of interest is to determine how much of a phase delay for each harmonic is allowed relative to the fundamental without detrimental effect to the fidelity of the square wave.

Figure 18:
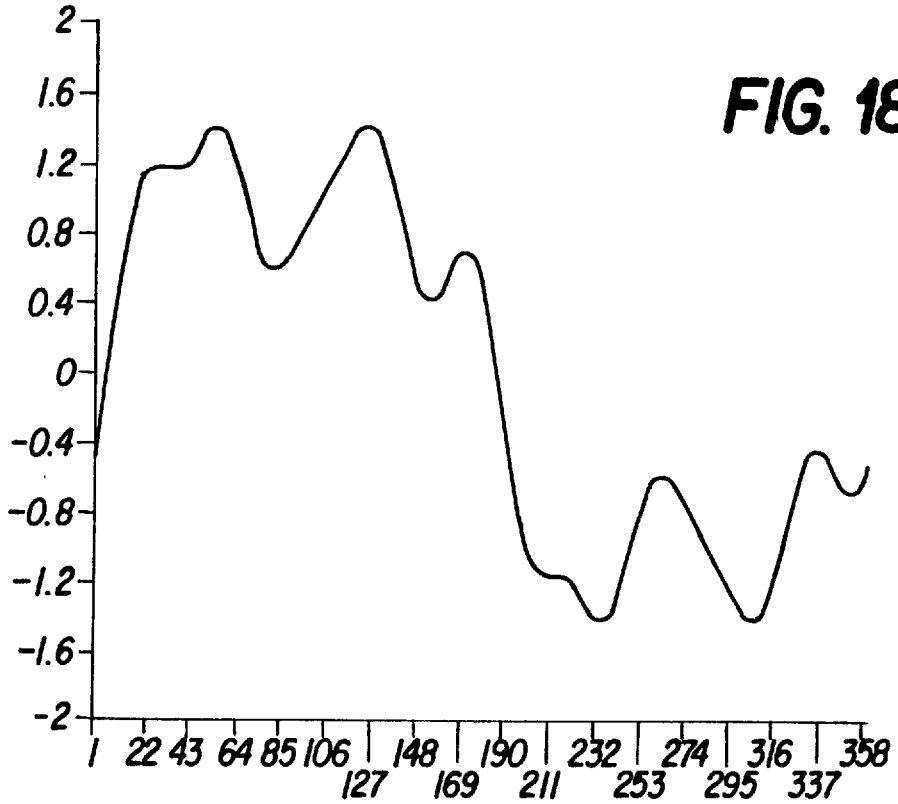
FIG. 18 shows a waveform with an 8% phase error.

Using four signal sources, one for each harmonic of interest, the following procedure is used. If, for example, the third harmonic is 15° out of phase with the fundamental, the fifth, seventh, and ninth harmonics are 25°, 35°, and 45° out of phase. FIG. 18 shows the waveform representative of the 8% phase error. The resulting waveform still resembles a square wave, albeit of poor fidelity. The waveform will be considered to have approximately a 5% bandwidth. The bandwidth can be increased, but the resulting efficiency of the power amplifier is adversely affected.

As can be seen, all of the actual measurements are better than predicted for the VSWR. With the actual circuit matching the simulation circuit, the divider topology according to the present invention has become a proven design.

While a preferred embodiment of the invention has been set forth above, those skilled in the art who have reviewed this disclosure will readily appreciate that many other embodiments can be realized within the scope of the invention. For example, any suitable transmission line can be used. Also, while the phase difference has been disclosed as being caused by a difference between the electrical lengths of the two output transmission lines, the phase delay can be introduced in any other way. Furthermore, the phase difference between the output ports can be 180° or any multiple thereof. The phase differences between the output ports and the input ports can be offset by any amount; for example, the differences can be 180° and 360°, 90° and 270°, or any other set of values having a difference which is a non-zero integer multiple of 180°.

What is claimed is:

1. A power divider for dividing a harmonically rich input signal into a first output signal and a second output signal, the power divider comprising:

an input transmission line for transmitting the input signal to a T-point at which the input signal is split into a first portion and a second portion;

a first output transmission line having a length which is a first non-zero integer multiple of approximately $\lambda/2$ of a wavelength of a fundamental frequency of the input signal, the first output transmission line receiving the first portion of the input signal at the T-point for transmitting the first portion while imparting a first phase delay to the first portion of the input signal to form the first output signal; and a second output transmission line having a length which is a second non-zero integer multiple that is at least twice the value of the first non-zero integer multiple of the first transmission line, the second output transmission line receiving the second portion of the input signal at the T-point for transmitting the second portion while imparting a second phase delay to the second portion of the input signal to form the second output signal;

wherein the first phase delay and the second phase delay have a difference which is a non-zero integer multiple of 180°, and the ratio of lengths of said first and second output transmission lines provide that harmonic frequencies output from each of the output transmission lines are in phase with each other.

2. A power divider as in claim 1, wherein the difference is 180°.

3. A power divider as in claim 1, wherein each of the input transmission line, the first output transmission line, and the second output transmission line is an electrically conductive transmission line; and the harmonically rich input signal is a square wave; and an amplitude of the first output signal is approximately equal to an amplitude of the second output signal.

4. A power divider as in claim 3, wherein each of the input transmission line, the first output transmission line, and the second output transmission line is a coaxial transmission line.

5. A power divider as in claim 3, wherein each of the input transmission line, the first output transmission line, and the second output transmission line is a microstrip line.

6. A power divider as in claim 5, wherein:

the first output transmission line has a first number of bends; and the second output transmission line has a second number of bends which is different from the first number of bends.

7. A power divider as in claim 3, wherein the length of the first transmission line is approximately $\lambda/2$ of the fundamental frequency of the input signal, and the length of the second transmission line is approximately equal to the wavelength of the fundamental frequency of the input signal.

8. A power divider as in claim 7, wherein the input transmission line, the first output transmission line, and the second output transmission line are formed as part of a stripline assembly.

9. A power divider as in claim 1, wherein the length of the first transmission line is approximately $\lambda/2$ of the fundamental frequency of the input signal, and the length of the second transmission line is approximately equal to the wavelength of the fundamental frequency of the input signal.

10. A power divider as in claim 9, wherein the input transmission line, the first output transmission line, and the second output transmission line are formed as part of a stripline assembly.

11. A power divider as in claim 1, wherein the input transmission line, the first output transmission line, and the second output transmission line are formed as part of a stripline assembly.

12. A method of dividing a harmonically rich input signal into a first output signal and a second output signal, the method comprising:

(a) splitting the input signal into a first portion and a second portion;

(b) imparting a first phase delay to the first portion of the input signal by providing a first transmission line having a length which is a non-zero integer multiple approximately $\lambda/2$ of a wavelength of a fundamental frequency of the input signal to form the first output signal;

(c) imparting a second phase delay to the second portion of the input signal by providing a second transmission line having a length which is a non-zero integer multiple of at least twice the value of the non-zero integer multiple of the first transmission line to form the second output signal;

wherein the first phase delay and the second phase delay have a difference which is a non-zero integer multiple of 180°, and the ratio of lengths of said first and second output transmission lines provide that harmonic frequencies output from each of the output transmission lines are in phase with each other.

13. A method as in claim 12, wherein the difference is 180°.

14. A method as in claim 12, wherein steps (a)–(c) are performed in electrically conductive transmission lines.

15. A method as in claim 14, wherein each of the electrically conductive transmission lines is a coaxial transmission line.

16. A method as in claim 14, wherein all of the electrically conductive transmission lines are formed as one of a microstrip line and a stripline assembly.

17. A method according to claim 12, wherein the length of the first transmission line provided in step (b) is approximately $\lambda/2$ of the fundamental frequency of the input signal; and the length of the second transmission line provided in step (c) is approximately equal to the wavelength of the fundamental frequency.

18. A method according to claim 17, wherein an amplitude of the first output signal provided in step (b) and an amplitude of the second output signal provided in step (c) are approximately equal.

19. A method as in claim 17, wherein the input transmission line, the first transmission line, and the second output transmission line are all formed as one of a microstrip line assembly and a stripline assembly.

20. A method according to claim 12, wherein an amplitude of the first output signal provided in step (b) and an amplitude of the second output signal provided in step (c) are approximately equal; and a frequency of the first output signal and the second output signal are approximately equal.

* * * * *